US006184469B1

(12) United States Patent
Conti

(10) Patent No.: US 6,184,469 B1
(45) **Date of Patent: *Feb. 6, 2001**

(54) TWO JOINED INSULATED RIBBON CONDUCTORS

(76) Inventor: Mario W. Conti, 7044 Estrella de Mar Rd., Carlsbad, CA (US) 92008

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/104,416

(22) Filed: Jun. 25, 1998

(51) Int. Cl.[7] ..... H01B 3/00

(52) U.S. Cl. ..... 174/72 TR; 174/70 C; 174/79; 174/92; 174/110 PM; 174/255; 439/492

(58) Field of Search ..... 439/492; 174/72 TR, 174/72 R, 72 A, 70 C, 98, 96, 110 PM, 79, 92, 255

(56) References Cited

U.S. PATENT DOCUMENTS 3,697,925 * 10/1972 Henschen ..... 439/494
3,875,478 * 4/1975 Capstick ..... 361/767
4,563,050 * 1/1986 Greenwood et al. ..... 439/495
4,934,956 * 6/1990 Conti ..... 439/492
5,374,788 * 12/1994 Endoh et al. ..... 174/266
5,499,170 * 3/1996 Gagne ..... 362/84
6,098,282 * 8/2000 Frankeny et al. ..... 29/852

* cited by examiner

*Primary Examiner*—Kristine Kincaid
*Assistant Examiner*—Adolfo Nino
(74) *Attorney, Agent, or Firm*—Edgar W. Averill, Jr.

(57) ABSTRACT

A folded insulated ribbon conductor having a pair of joined twice folded conductors. The folded insulated ribbon conductor has an outer layer of a thin flexible length of insulative material. A thin flexible conductive ribbon is adhered to one side of the insulator. A first one hundred eighty degree fold is formed along one edge where the conductor and the insulator are folded toward the center of the length. A second one hundred eighty degree fold is formed along the other edge of the conductor. Conductive jacks may be connected to this conductor by unfolding the first fold and inserting a jack through the ribbon and the conductor near the first fold and then refolding the first fold to provide two points of contact for the jack. The pair of folded conductors may be joined by insulative disks which also support the conductive jacks.

5 Claims, 2 Drawing Sheets

TWO JOINED INSULATED RIBBON CONDUCTORS

BACKGROUND OF THE INVENTION

The field of the invention is electrical conductors and the invention relates more particularly to ribbon style of flexible conductors of the general type shown in U.S. Pat. No. 4,934,956 naming the applicant as the inventor and most widely used for low voltage lighting strips.

In U.S. Pat. No. 4,934,956 a single width of an insulative tape is laminated to a pair of parallel thin ribbon conductors. Next, a non-conductive ply is laminated to the exposed side of the ribbon conductors. This results in a continuous strip of two flat electrical conductors on a common carrier, the total surface of which is completely insulted, resulting in a flat ribbon equivalent of "zip cord." To each conductor a jack is connected by punching the ribbon and suitably bonding the jack to said ribbon, providing electrical continuity for bi-pin lamps and similar components. This process is complicated by the fact that to achieve a positive electrical connection, the insulating matter has to be penetrated or removed while maintaining the integrity of the conductor. Swaging was determined to be the only suitable method of fixing the jacks to the conductors. Therefore, in order to permit swaging, a through hole is required on the bottom of the jack, creating a real and serious problem. This problem occurs when leads of lamps or other components are inserted in jacks. These leads have pointed ends which are quite sharp and often extend through the hole in the bottom of the jack. This condition creates the possibility of the tip of the pin being able to penetrate the insulation of the opposing conductor since said conductor is often positioned in alignment with the hole in the bottom of the jack causing a short circuit. Further, reliability of the system has been improved by orders of magnitude in the implementation of a new and superior system. Thus, an improved product and process is needed.

BRIEF SUMMARY OF THE INVENTION

It is an object of the present invention to provide a insulated ribbon conductor and a method of connecting components thereto which provide an improved electrical contact between the component and the ribbon conductor. Also, providing a material which is significantly more user friendly.

The present invention is for a folded insulated ribbon conductor having an insulator comprising a thin flexible length of an insulative material. A conductor comprising a thin flexible conductive ribbon is affixed to an inner surface of the insulator. A first fold is made which forms a first crease parallel to the central axis of the insulator and the conductor so that the insulator is on an outer edge of the first crease so that the conductive side of the conductor faces and is capable of electrically contacting the conductive side of the conductor. A second fold forms a second crease parallel to the central axis of the insulator and the conductor so that the insulator is on an outer edge of the second crease. Once again, the conductive side of the conductor faces an adjacent conductive side of the same conductor. Preferably, the insulator extends beyond the edges of the conductor so that the folded conductor is formed without any exposed conductor. The process of the present invention is the connecting of the conductor of the present invention to an electrically conductive jack by the process of unfolding the first fold sufficiently to expose a portion of the conductive side of the conductor to provide an exposed conductive area. A jack is inserted through the conductor and the insulator at the exposed conductive area and soldered to form a first contact point. Next, the first fold is refolded so that the termination of the jack is sandwiched between two plies of the copper conductor.

DESCRIPTION OF THE PREFERRED EMBODIMENTS

Figure 1:
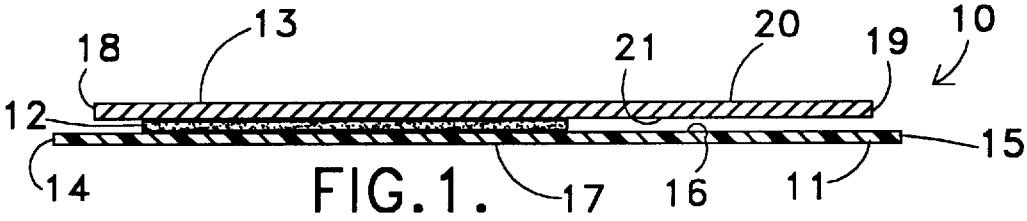
FIG. 1 is a cross-sectional view of an insulator adhered to a ribbon conductor.

FIG. 1 is a cross-sectional view showing an unfolded conductor comprising an insulator 11 which is a thin flexible length of an insulative material such as a polyester film. Layer 12 is an adhesive and layer 13 is a flat ribbon conductor preferably made of copper. Insulator 11 has a first side 14, a second side 15, an interior surface 16 and an exterior surface 17. Conductor 13 has a first edge 18, a second edge 19, conductive surfaces 20 and 21, surface 21 being an insulated side. Typical dimensions would be a polyester film thickness of two mils, a width of 1⅝". The copper ribbon would preferably be two or three mils in thickness with a width of 1½". Preferably, the insulator is wider than the copper strip by 1/16" to ⅛". The adhesive 12 can be a non-conductive adhesive since there is no flow of electricity from the conductive surface 21 of conductor 13 to the insulator 11.

Figure 2:
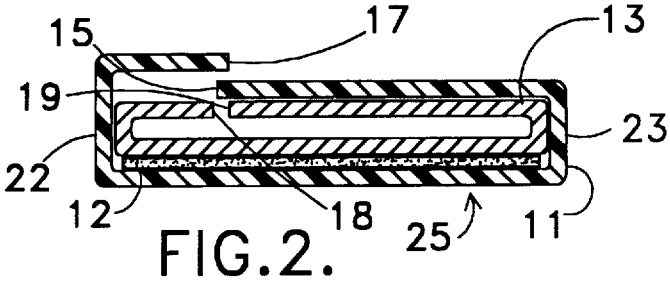
FIG. 2 is the insulator adhesive and conductor of FIG. 1 folded over twice.

It is anticipated that the conductor would be supplied in rolls such as that shown in FIG. 2 where a first one hundred eighty degree fold 22 and a second fold 23 are formed so that the insulator 11 is on the outer side of the creases formed by these folds. It is to be understood that the folds shown in the drawing are exaggerated so that the relationship of the layers is evident. Fold 22 is actually a far tighter fold.

Figure 3:
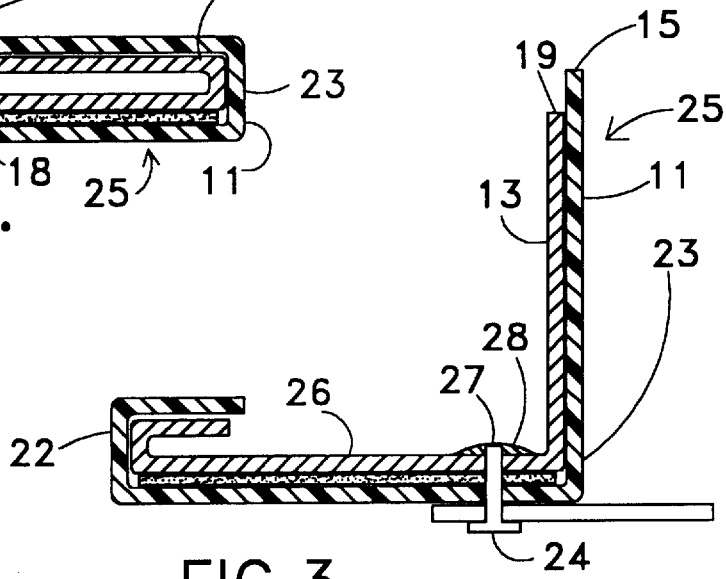
FIG. 3 is a cross-sectional view of FIG. 2 with the first fold unfolded.
Figure 5:
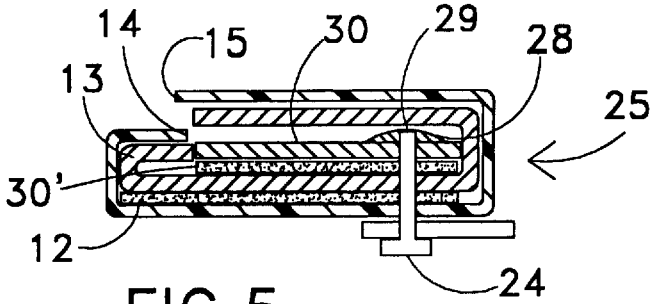
FIG. 5 is a folded over view of the alternate embodiment of FIG. 4.

Next, when it is time to connect a jack such as microjack 24 of FIG. 5, the roll of folded insulated ribbon conductor 25 of FIG. 2 is unrolled and partially unfolded to the position in FIG. 3. There the second fold 23 is partly unfolded to provide an exposed conductive area 26. Next, a jack 24 is inserted so that its base 27 protrudes through the conductive ribbon which, when soldered, makes a first electrical contact point 28 with conductor 13.

Next, fold 23 is refolded so that conductor 13 covers the base 27 of jack 24 to provide a second electrical contact point 29. Preferably, the jack 24 would be soldered to the exposed conductive area 26 prior to the refolding second fold 23.

Figure 4:
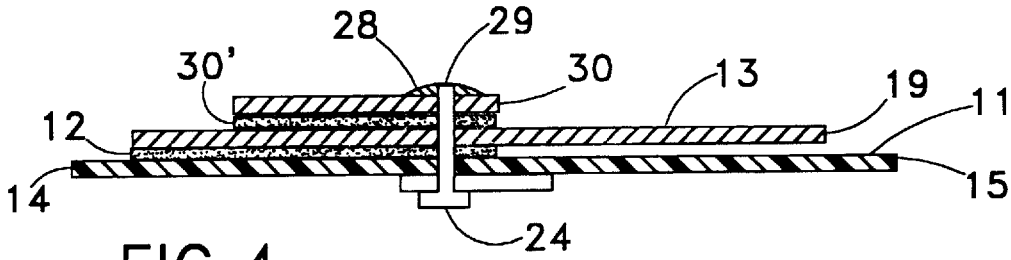
FIG. 4 is a cross-sectional view of an alternate embodiment with a second conductor to increase ampacity and including a socket.

The design of the ribbon conductor of the present invention permits the insertion of a second strip of copper as indicated in FIGS. 4 and 5 where the second strip of copper is indicated by reference character 30. Strip 30 may be adhered to conductor 13 by a conductive adhesive 30'. Furthermore, a third strip of copper can be added to still further increase the current carrying capacity of the ribbon conductor.

Figure 6:
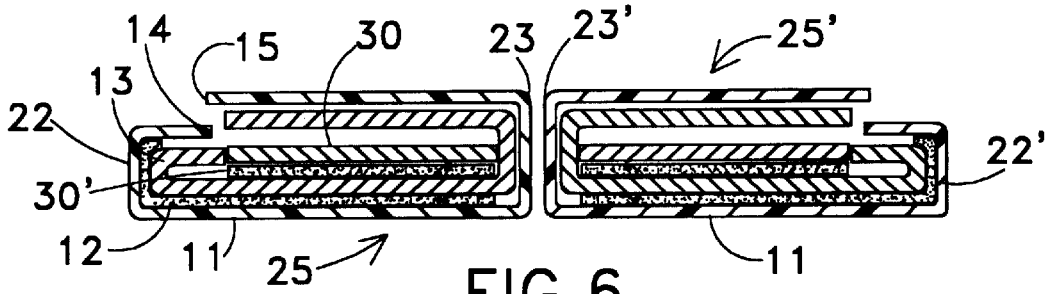
FIG. 6 is a cross-sectional view of a pair of folded ribbon conductors abutted along one side.
Figure 7:
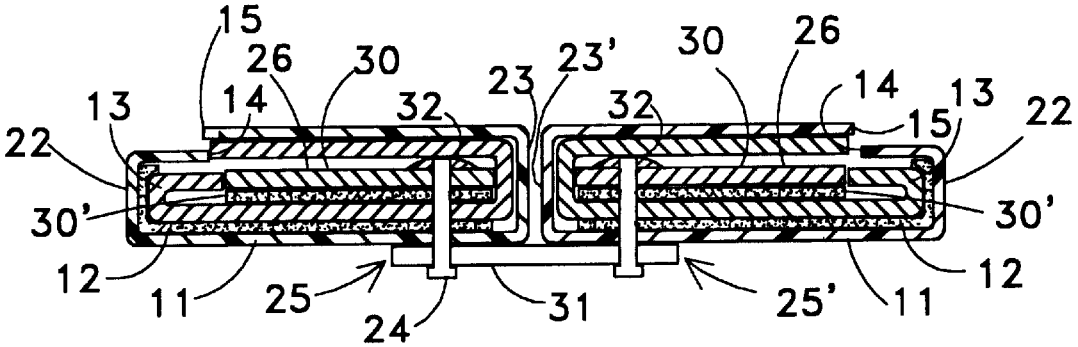
FIG. 7 is a cross-sectional view of the pair of folded ribbon conductors of FIG. 6 with both of the conductors folded and a pair of jacks soldered to parallel conductors.
Figure 8:
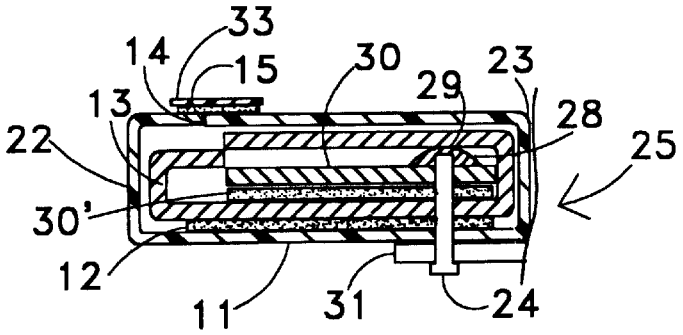
FIG. 8 is a cross-sectional view of one of the conductors of FIG. 7 in a folded configuration, further including a strip of insulative tape.

To fabricate a length of dual conductive wire with sockets affixed to it, the steps indicated in FIGS. 6, 7, and 8 would be used. A pair of insulated ribbon conductors 25 and 25' are shown in FIG. 6 with their second folds 23 and 23' abutting one another. In production this would be carried out by having two rolls of folded conductors with the opposite orientation continuously unrolled to a position in FIG. 6. Next, folds 23 and 23' would be unfolded to expose a conductive area 26. Next a socket 24 would be placed through insulative disk 31 and connected to the exposed conductive area 26' by solder 32. This would be done on both halves of the conductor so that there would be a pair of sockets 24. Next, the conductor would be refolded to a position shown in FIG. 8 where the first and second electrically conductive points 28 and 29 are clearly indicated providing an excellent electrical contact for jack 24. Lastly, a strip of insulative adhesive tape 33 is continually placed over the intersection between the first and second sides 14 and 15 of insulator 11.

Figure 9:
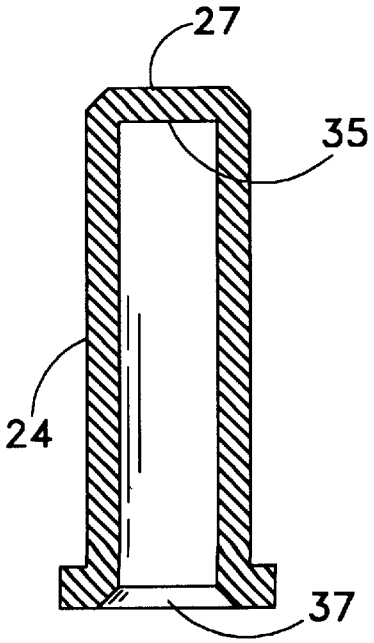
FIG. 9 is a cross-sectional view of a jack of the type shown in FIGS. 3–5 and 7–8.

Yet another safeguard to eliminate any possibility of a lamp pin extending past the jack is to use a jack with a closed end. This is shown in FIG. 9 where jack 24 has a closed end 35 and a connector end 37.

The result is a basic new single conductor composed of a number of plies of flat conductor material (preferably copper) as o well as flat insulating material (preferably of the type sold under the trademark "MYLAR") which when assembled provides a flat ribbon of minimum thickness. Typically, this thickness would be about 1/100" which nonetheless provides the electrical equivalent of a No. 10 wire conductor. Thus, a single high capacity conductor permits totally new capabilities by its ability to be connected to sockets and also its ability to be placed against a surface. Also, in the event a pin placed through jack 24 longer than that for which it is designed, it will not cause a short circuit since the bottom of jack 24 is closed, and the ribbon surface is protected by a second ply of copper which for all practical purpose would be impossible to penetrate before seeing the second circuit. Therefore, the two conductors 24 and 24' may overlie one another without risk. From a production standpoint, it is also far easier to fold back fold 22 as indicated in FIG. 3 than it is to strip the end of a length of wire. Furthermore, the wire does not have to be cut to make connections to a socket. Because of the flexibility of the conductor and insulative ribbon combination, it can be folded lengthwise to provide a narrower pair of ribbons if desired.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. First (25) and second (25') joined, twice folded insulated conductive ribbon assemblies forming a dual insulated ribbon conductor comprising:

a first assembly and a second assembly, each comprising:

an insulator (11) comprising a thin flexible length of an insulative material having a central axis, an inner surface (16), and an exterior surface (17);

a conductor ribbon comprising at least one thin flexible conductive ribbon (13) touching the inner surface (16) of said insulator (11), said conductive ribbon (13) having a first edge (18), a second edge (19), an insulated side (21), and a conductive side (20), a central axis parallel to said central axis of said insulator, said insulator (11) and said conductive ribbon (13) forming an unfolded insulated conductive ribbon;

an electrically conductive jack (24) having an inner end (36) electrically connected to said conductive ribbon (13) and a connector end (37) positioned outwardly of said insulator (11);

a first 180 degree fold (22) in said unfolded insulated conductive ribbon forming a once folded insulated conductive ribbon, said first 180 degree fold being parallel to said central axis of said insulator (11) so that said insulator (11) is on an outer edge of said first 180 degree fold (22);

a second 180 degree fold (23) in said once folded insulated conductive ribbon forming a twice folded insulated conductive ribbon, said second 180 degree fold being parallel to said central axis of said insulator (11) so that said insulator is on an outer edge of said second 180 degree fold and further, so that said conductive side (20) of said conductive ribbon (13) faces an adjacent area of the conductive side (20) of said conductive ribbon (13) and the inner end (36) of said jack (24); and said first assembly and said second assembly joined to form said dual insulated ribbon conductor by at least one insulative disk (31) spanning an intersection between said first assembly and said second assembly, each of said at least one insulative disk supporting adjacent pairs of said electrically conductive jacks (24, 24').

2. The joined ribbon assemblies of claim 1 wherein said at least one insulative disk (31) provides the sole support between said first and second assembly.

3. The joined ribbon assemblies of claim 1 wherein said second one hundred eighty degree folds positions a portion of said conductive side (20) of said conductive ribbon (13) facing and in electrical contact with said inner end (36) of said jack (24).

4. The joined ribbon assemblies of claim 1 wherein said thin flexible conductive ribbon (13) is adhered to said insulator (11).

5. The joined ribbon assemblies of claim 1 further including a second conductive ribbon in each of said first and second, joined, twice folded insulated conductive ribbon assemblies captured by second one hundred eighty degree fold of each respective ribbon assembly.

* * * * *